US007290538B2

(12) United States Patent
Lai

(10) Patent No.: US 7,290,538 B2
(45) Date of Patent: Nov. 6, 2007

(54) VALVE STRUCTURE OF A PAINT BULLET GUN

(76) Inventor: Bao Shyan Lai, No. 839, Wunsin S. Rd., Nantun District, Taichung City 408 (TW)

( * ) Notice: Subject to any disclaimer, the term of this patent is extended or adjusted under 35 U.S.C. 154(b) by 79 days.

(21) Appl. No.: 11/298,466

(22) Filed: Dec. 12, 2005

(65) Prior Publication Data

US 2007/0131210 A1 Jun. 14, 2007

(51) Int. Cl.
*F41B 11/32* (2006.01)

(52) U.S. Cl. ..... 124/73; 124/71

(58) Field of Classification Search ..... 124/71–77
See application file for complete search history.

(56) References Cited

U.S. PATENT DOCUMENTS

| | | | | |
|---|---|---|---|---|
| 5,613,483 | A * | 3/1997 | Lukas et al. | 124/73 |
| 6,418,920 | B1 * | 7/2002 | Marr | 124/74 |
| 6,561,887 | B2 * | 5/2003 | Lai et al. | 451/358 |
| 6,808,341 | B2 * | 10/2004 | Lai et al. | 409/134 |
| 6,990,971 | B1 * | 1/2006 | Moritz | 124/31 |
| 7,069,922 | B1 * | 7/2006 | Orr | 124/73 |
| 7,111,621 | B2 * | 9/2006 | Lin | 124/74 |
| 2003/0230296 | A1 * | 12/2003 | Farrell | 124/73 |
| 2004/0089280 | A1 * | 5/2004 | Kunimoto | 124/76 |
| 2005/0115552 | A1 * | 6/2005 | Dobbins | 124/73 |
| 2006/0060178 | A1 * | 3/2006 | Lai | 124/74 |
| 2006/0162712 | A1 * | 7/2006 | Yeh | 124/73 |
| 2006/0162716 | A1 * | 7/2006 | Dobbins et al. | 124/77 |
| 2006/0225718 | A1 * | 10/2006 | Kirwan | 124/71 |
| 2007/0028910 | A1 * | 2/2007 | Quinn et al. | 124/73 |
| 2007/0051353 | A1 * | 3/2007 | Nygarrd et al. | 124/73 |
| 2007/0068502 | A1 * | 3/2007 | Jones et al. | 124/77 |

* cited by examiner

*Primary Examiner*—Michael J. Carone
*Assistant Examiner*—Stewart T Knox
(74) *Attorney, Agent, or Firm*—Rosenberg, Klein & Lee

(57) ABSTRACT

An arrestor drives a valve-body. An air source supplies air into the valve-body to control a strike-controlling unit and bolt to reciprocally move. The valve-body has linking and arresting sections. The arresting section communicates with the linking section via a ventiduct. The arresting section is formed with a passage. An inner wall of the passage has a sloped annular groove. The annular groove communicates with the air source via an intake. A shaft and resilient member are accommodated in the passage. The shaft is reciprocally drivable by the arrestor and resilient member. Via a relief duct, the ventiduct communicates with a part of the passage where the resilient member is accommodated. The arresting section is formed with an escape hole via which the passage communicates with the outer side. The shaft is formed with a first annular groove corresponding to the annular groove of the passage.

7 Claims, 9 Drawing Sheets

VALVE STRUCTURE OF A PAINT BULLET GUN

BACKGROUND OF THE INVENTION

The present invention is related to a valve structure of a paint bullet gun, in which by means of a relief duct of a ventiduct of the valve body, the gunlock can stably reciprocally move to normally continuously shoot the paint bullets.

FIG. 7 shows an existent paint bullet gun having a barrel 81 and a handle 85. A piston rod 83 is disposed in front section of the barrel 81. An intake 811 is formed on rear section of the barrel 81. A striker 82 is accommodated in the rear section of the barrel 81 in front of the intake 811. A gunlock 86 is connected with upper side of the striker 82. A resilient member 84 is compressed between the striker 82 and the piston rod 83. An electromagnet 9 is arranged in the handle 85 for controlling intake. The electromagnet 9 communicates with the intake 811 of the barrel 81. The electromagnet 9 is magnetized and demagnetized to control intake and exhaustion of the intake 811. Accordingly, the striker 82 and the gunlock 86 can reciprocally move to continuously shoot paint bullets.

Referring to FIG. 8, an extensible central shaft 91 is disposed in the electromagnet 9. The central shaft 91 is formed with an annular groove 911. A distributor 92 is fixed at one end of the electromagnet 9. The distributor 92 is formed with a shaft hole 921 corresponding to the central shaft 91. A spring 925 is positioned in the shaft hole 921. The circumferential wall of the shaft hole 921 is radially formed with a first vent 922, a second vent 923 and an exhaust port 924. The first vent 922, second vent 923 and exhaust port 924 are not aligned with each other. The central shaft 92 can be extended/retracted to switch the intake and exhaustion states.

According to the above arrangement, after the paint bullet gun shoots a paint bullet, the electromagnet 9 will be first demagnetized. At this time, the central shaft 91 is pushed by the spring 925 to restore to its home position. Under such circumstance, the first and second vents 922, 923 do not communicate with each other. Also, the striker 82 is resiliently forced by the resilient member 84 and restored to the position of the intake 811. Simultaneously, the air accumulating in the barrel 81 is exhausted through the second vent 923 from the exhaust port 924. In addition, when the striker 82 is restored to its home position, the gunlock 86 is also restored.

When the paint bullet gun continuously shoots the paint bullets, the striker 82 is continuously reciprocally moved for shooting the paint bullets. The exhaust port 924 is formed on the bottom of the distributor 92. It often takes place that after a paint bullet is shot from the barrel 81, before the air is fully exhausted from the exhaust port 924, the next wave of air enters the paint bullet gun. As a result, the striker 82 is pushed and advanced before restoring to its home position. Therefore, the striker 82 is not truly operated within the barrel 81 and thus the gunlock 86 is not truly operated. This often leads to clog or breakage of the paint bullets.

Moreover, the exhaust port 924 is formed on the bottom of the distributor 92 and the first and second vents 922, 923 are not aligned with each other by a considerably long distance. Therefore, the travel of the central shaft 91 is relatively long. As a result, the shooting rate is lowered. In order to more effectively shoot the paint bullets, a high-power electromagnet 9 must be used. This leads to increment of power consumption.

It is therefore tried by the applicant to provide an improved paint bullet gun which is able to exhaust the air from the barrel 81 in time and continuously stably shoot paint bullets at high speed.

SUMMARY OF THE INVENTION

It is therefore a primary object of the present invention to provide a valve structure of a paint bullet gun. By means of a relief duct of a ventiduct of the valve body, when a shooting operation is completed, the air accumulating in the tunnel of the valve body will go through the ventiduct and the relief duct to be exhausted out of the valve body. Therefore, the air pressure of the ventiduct and the tunnel can be quickly relieved and the linking member can be truly restored to its home position. Accordingly, the valve rod, the piston rod and the gunlock can be all truly restored for next shooting. Therefore, the paint bullet gun can normally continuously shoot the paint bullets at high rate.

It is a further object of the present invention to provide the above valve structure of the paint bullet gun, in which the diameters of the relief duct and the escape hole are smaller than the diameters of the ventiduct and the passage. Therefore, each time a paint bullet is to be shot, minor part of the air going into the ventiduct will escape through the relief duct into the passage to normally relieve the pressure. In addition, after each shooting operation, the air accumulating in the tunnel of the valve body can totally go through the ventiduct and the relief duct into the passage of the valve body. The air is reserved therein and then exhausted through the escape hole out of the valve body. The reserved air helps the resilient member within the passage in pushing and restoring the shaft for next shooting. By means of such design, a resilient member with weaker elastic coefficient can be used to lower the power consumption of the electromagnet.

It is still a further object of the present invention to provide the above valve structure of the paint bullet gun, in which inner wall face of the passage of the valve body is formed with an annular groove corresponding to the intake. The annular groove has a trapezoidal cross-section with slopes for increasing the intake area. Therefore, the travel of the shaft in the passage is shortened. This also lowers the power consumption of the electromagnet for driving the linking member. Therefore, energy is saved.

According to the above objects, the valve structure of the paint bullet gun of the present invention includes a barrel and a handle, wherein:

a gunlock and a strike-controlling unit are disposed in the barrel, a valve body and an arrestor being disposed in the handle, the arrestor being adjacent to the valve body for driving the valve body, an air source being arranged under the barrel for supplying air into the barrel and the valve body to control the valve body and the strike-controlling unit, the strike-controlling unit serving to control the gunlock to reciprocally move for dropping a paint bullet and shooting the paint bullet with the air of the air source;

the valve body has a linking section and an arresting section, the linking section being formed with a tunnel, a linking member and a spring being sequentially mounted in the tunnel in a direction to an opening of the barrel;

the arresting section is formed with a passage communicating with the tunnel via a ventiduct, the passage communicating with the air source via an intake, the middle of the inner wall face of the passage being formed with an annular groove corresponding to the intake, the annular groove having a trapezoidal cross-section with slopes, whereby the air can go from the air source into the passage;

a shaft and a resilient member are accommodated in the passage, one end of the shaft contacting with the arrestor, the other end of the shaft being pushed by the resilient member, via a relief duct, the ventiduct communicating with a part of the passage, in which part the resilient member is accommodated, the arresting section being formed with an escape hole opposite to the relief duct, the escape hole communicating with the part of the passage, in which part the resilient member is accommodated, the diameters of the relief duct and the escape hole being smaller than the diameters of the ventiduct and the passage; and the shaft is formed with a first annular groove, when the shaft is reciprocally moved, the first annular groove being moved to a position corresponding to the ventiduct or moved away from the position corresponding to the ventiduct so as to switch the communication state and discommunication state between the first annular groove and the annular groove of the passage.

The present invention can be best understood through the following description and accompanying drawings wherein:

DETAILED DESCRIPTION OF THE PREFERRED EMBODIMENTS

Figure 1:
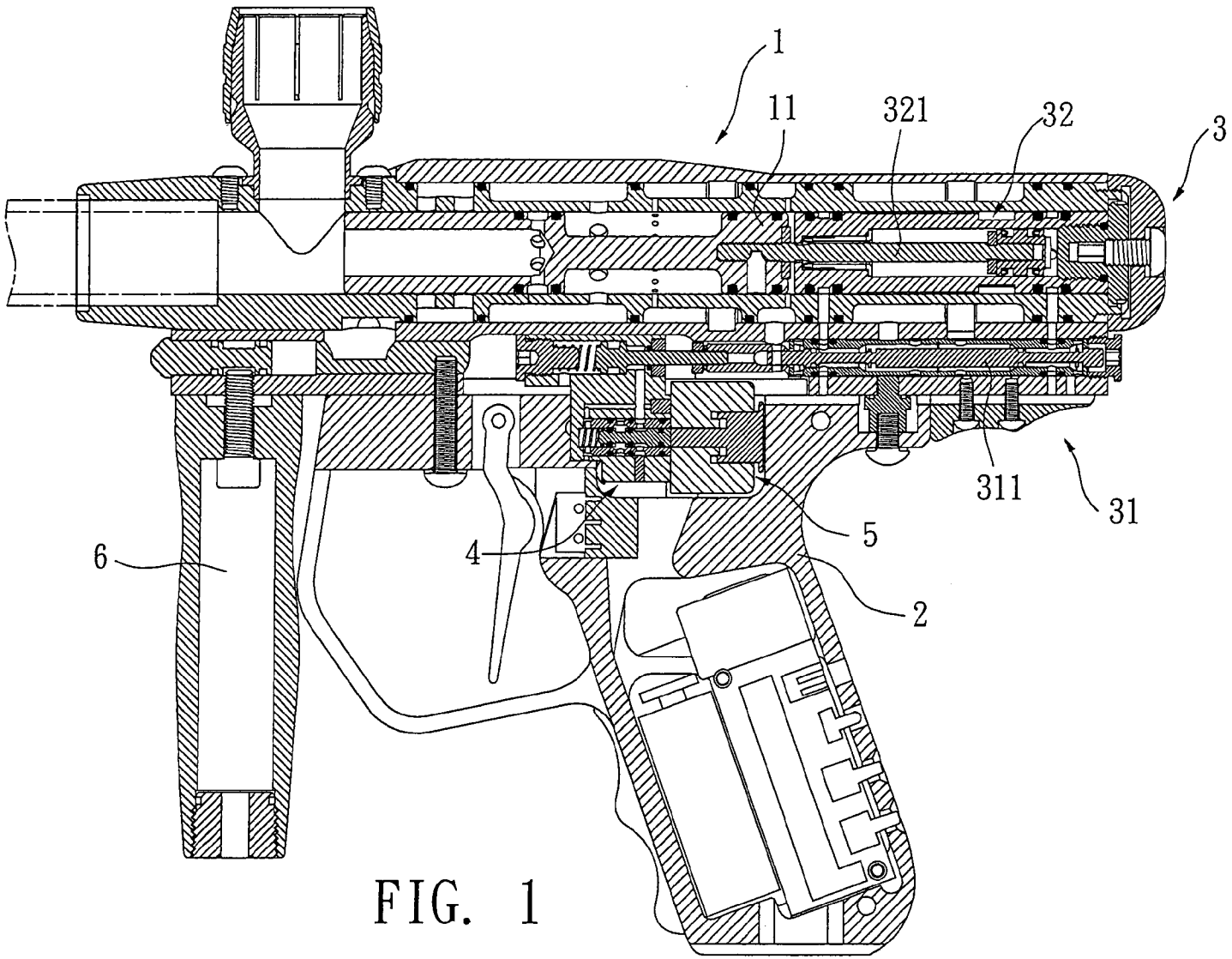
FIG. 1 is a sectional assembled view of the present invention.
Figure 2:
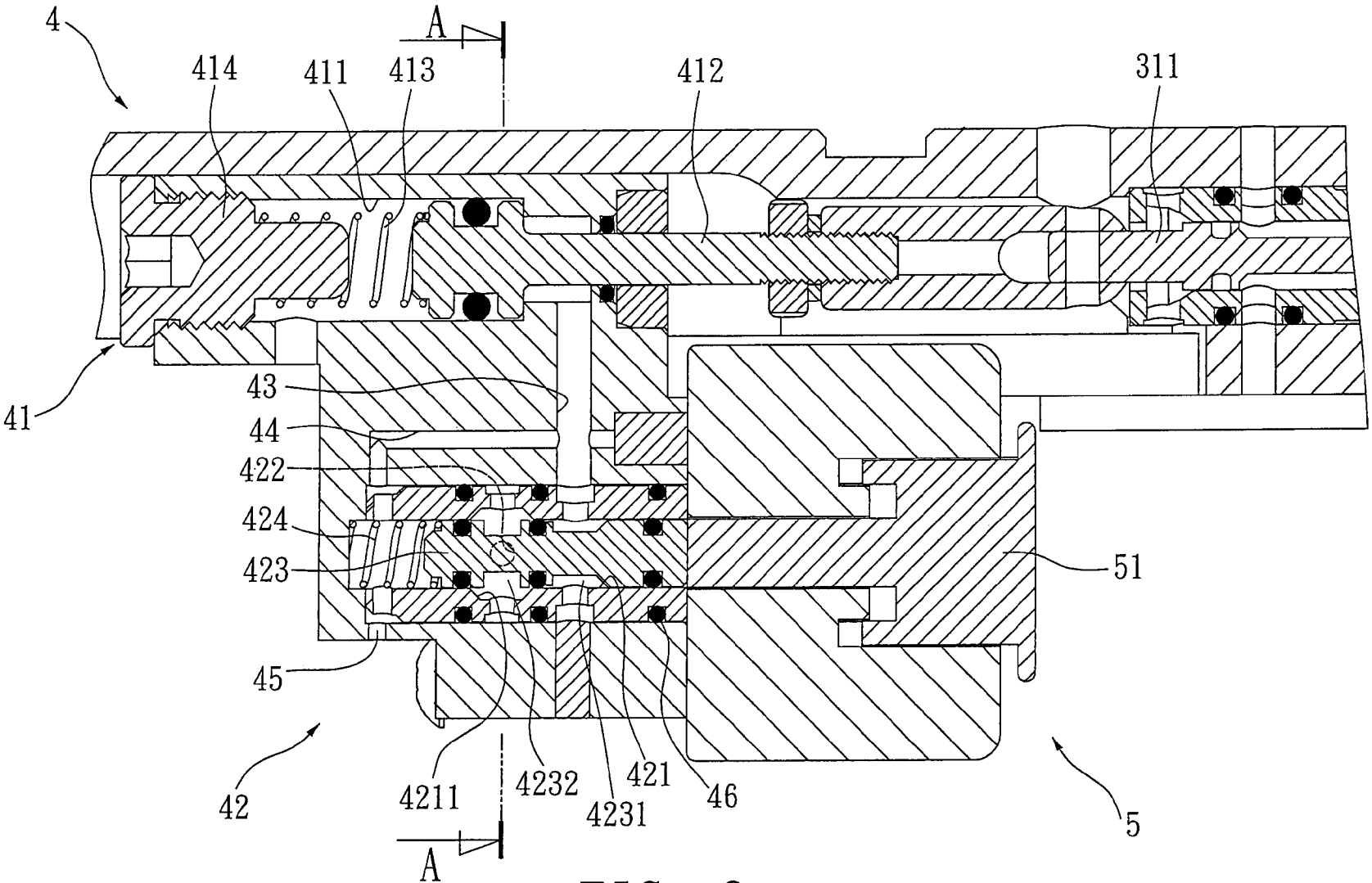
FIG. 2 is a sectional view of the valve body of the present invention.
Figure 2A:
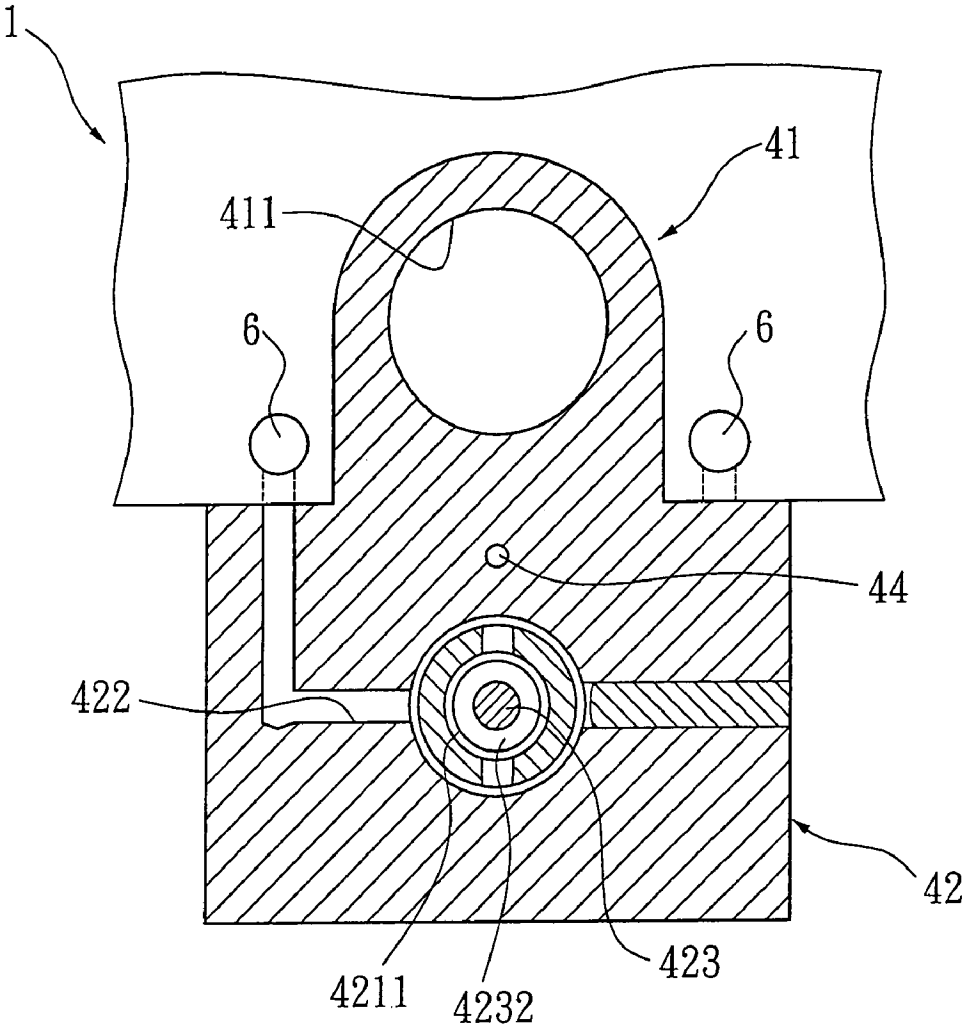
FIG. 2A is a partially sectional view taken along line A-A of FIG. 2, showing the communication between the air source and the intake.

Please refer to FIGS. 1 to 2A. The paint bullet gun of the present invention includes a barrel 1 and a handle 2.

A gunlock 11 and a strike-controlling unit 3 are disposed in the barrel 1. A valve body 4 and an arrestor 5 are disposed in the handle 2. The arrestor 5 is adjacent to the valve body 4 for driving the valve body 4. An air source 6 is arranged under the barrel 1 for supplying air into the barrel 1 and the valve body 4 to control the valve body 4 and the strike-controlling unit 3. The strike-controlling unit 3 serves to control the gunlock 11 to reciprocally move for dropping a paint bullet 7 and shooting the paint bullet 7 with the air of the air source 6.

The valve body 4 has a linking section 41 and an arresting section 42. The linking section 41 is formed with a tunnel 411. A linking member 412, a spring 413 and a cock 414 for blocking the tunnel 411 are sequentially mounted in the tunnel 411 in a direction to the opening of the barrel.

The arresting section 42 is formed with a passage 421 communicating with the tunnel 411 via a ventiduct 43. The passage 421 communicates with the air source 6 via an intake 422. The middle of the inner wall face of the passage 421 is formed with an annular groove 4211 corresponding to the intake 422. The annular groove 4211 has a trapezoidal cross-section with slopes. Accordingly, the air can go from the air source 6 into the passage 421.

A shaft 423 and a resilient member 424 are accommodated in the passage 421. One end of the shaft 423 contacts with the arrestor 5 and is pushed by the arrestor 5. The other end of the shaft 423 is pushed by the resilient member 424, whereby the shaft 423 can reciprocally move. Via a relief duct 44, the ventiduct 43 communicates with a part of the passage 421, in which part the resilient member 424 is accommodated. In addition, the arresting section 42 is formed with an escape hole 45 opposite to the relief duct 44. The escape hole 45 communicates with the part of the passage 421, whereby the air of the part of the passage 421 can be exhausted through the escape hole 45 out of the valve body 4. The diameters of the relief duct 44 and the escape hole 45 are smaller than the diameters of the ventiduct 43 and the passage 421.

The shaft 423 is formed with a first annular groove 4231 and a second annular groove 4232. When the shaft 423 is reciprocally moved, the first annular groove 4231 is moved to a position corresponding to the ventiduct 43 or moved away from the position corresponding to the ventiduct 43. Also, the second annular groove 4232 is moved to a position corresponding to the annular groove 4211 or moved away from the position corresponding to the annular groove 4211. Accordingly, the shaft 423 is reciprocally moved to switch the communication state and discommunication state between the first annular groove 4231 and the annular groove 4211. Several O-rings 46 are inlaid in the circumference of the shaft 423 on two sides of the first and second annular grooves 4231, 4232. The O-rings abut against the inner wall face of the passage 421 to avoid leakage.

By means of reciprocally moving the shaft 423, the air of the air source 6 can go through the intake 422, the annular groove 4211, the first annular groove 4231, the second annular groove 4232 and the ventiduct 43 into the tunnel 411 of the linking section 41 to reciprocally move the linking member 412. One end of the linking member 412 is connected with the strike-controlling unit 3 so as to control the operation of the strike-controlling unit 3.

The strike-controlling unit 3 further includes a valve housing 31 and a piston barrel 32. The interior of the valve housing 31 communicates with the air source 6 and the interior of the piston barrel 32, whereby the air input to the valve housing 31 can further go into the piston barrel 32. A valve rod 311 is mounted in the valve housing 31 and connected with one end of the linking member 412. A piston rod 321 is disposed in the piston barrel 32. One end of the piston rod 321 is connected with the gunlock 11 for driving the gunlock 11.

In this embodiment, the arrestor 5 is an electromagnet having a movable member 51. When the electromagnet is magnetized and demagnetized, the movable member 51 is reciprocally moved. One end of the movable member 51 is adjacent to the shaft 423 in the arresting section 42 of the valve body 4 for driving the shaft 423.

Figure 3:
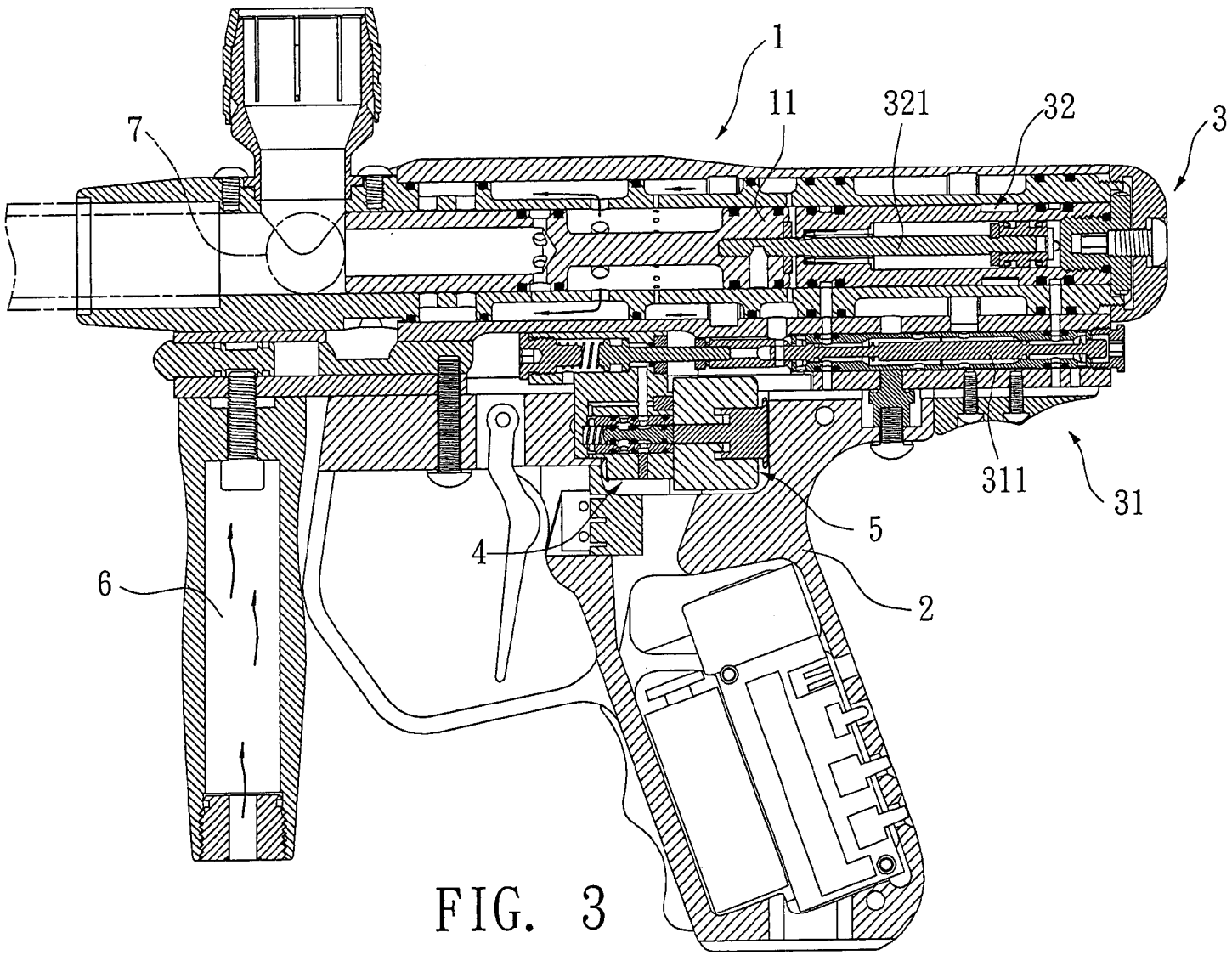
FIG. 3 is a sectional view showing the shooting operation of the present invention in a first state.
Figure 4:
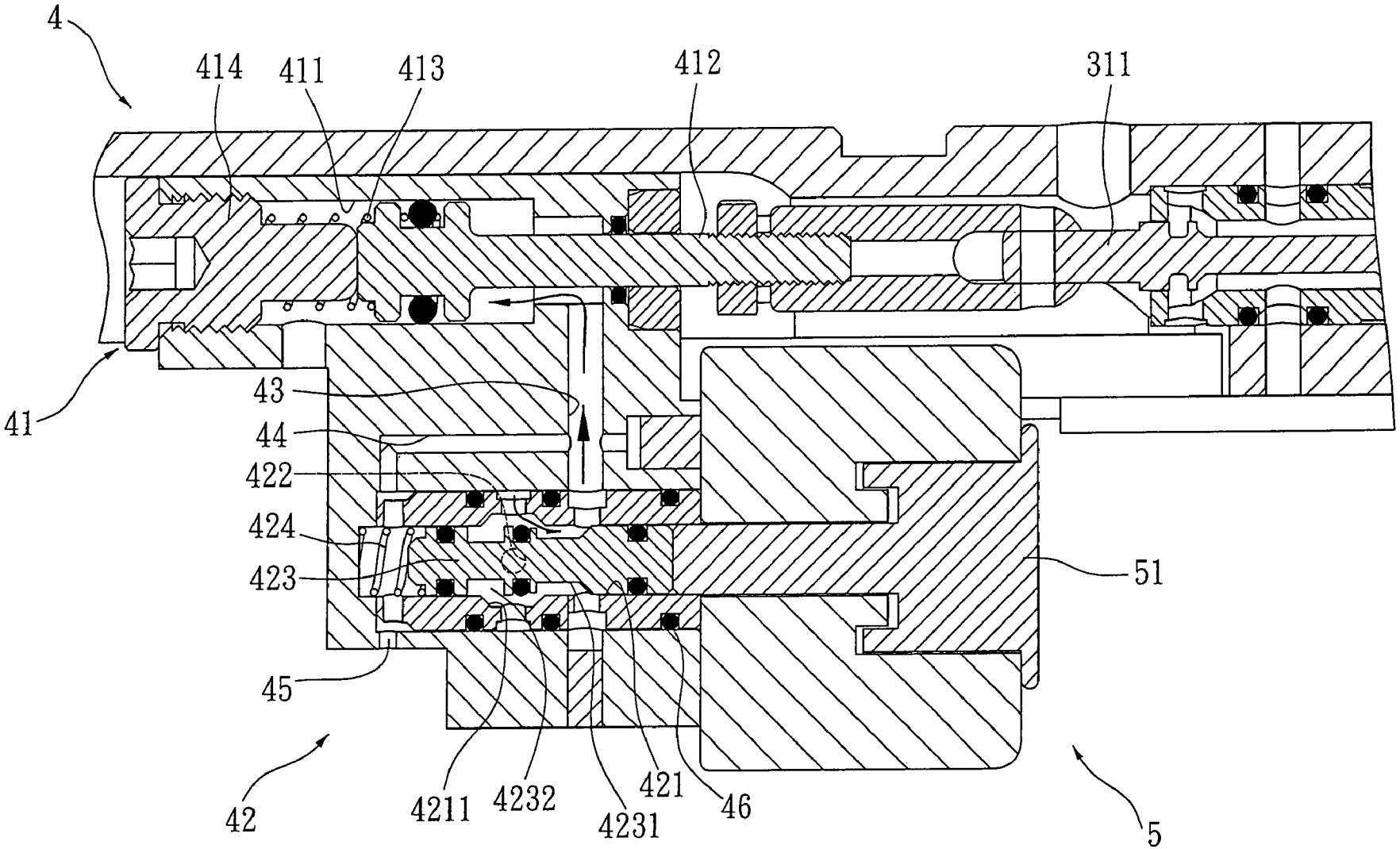
FIG. 4 is a sectional view showing the shooting operation of the present invention in a second state.
Figure 5:
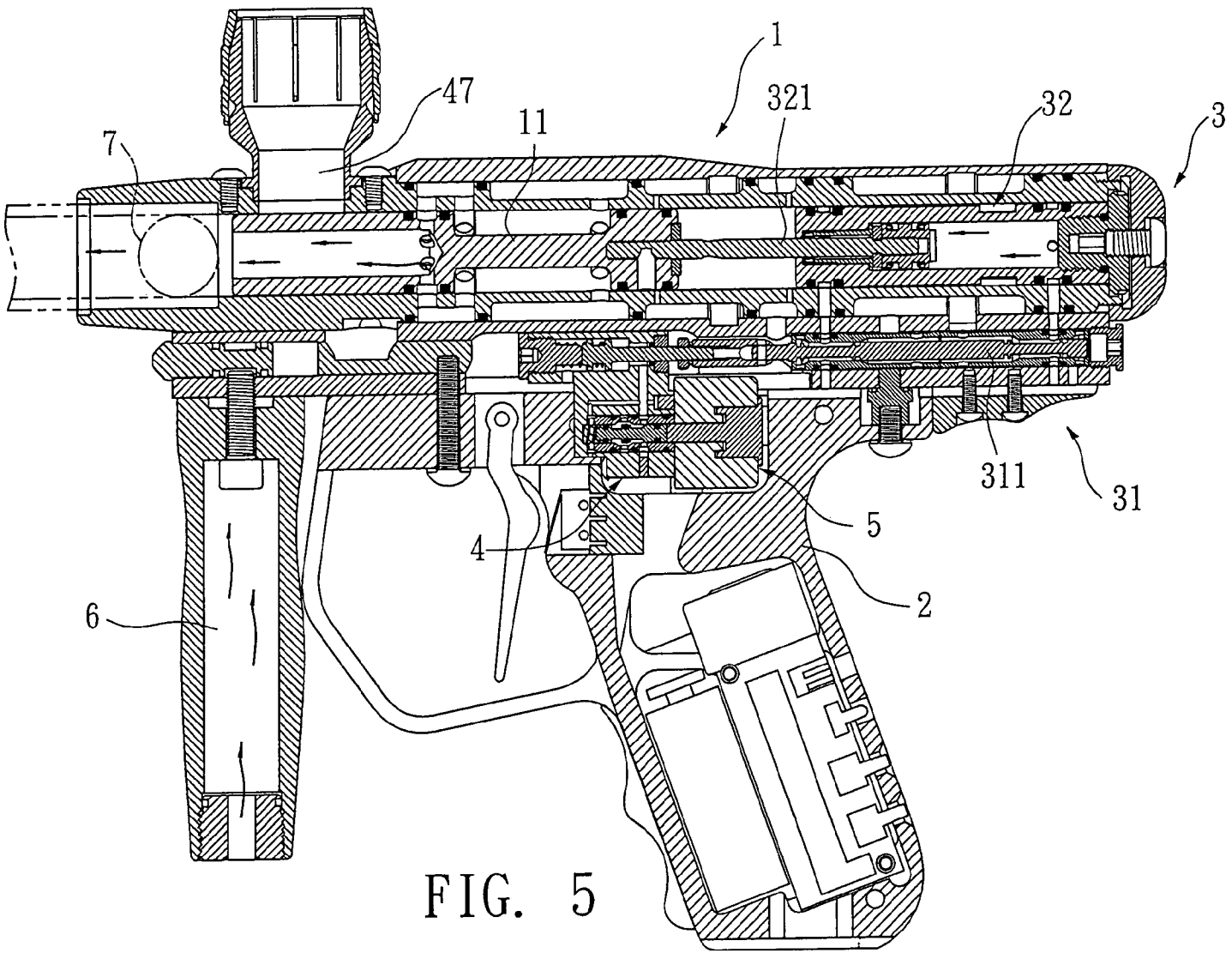
FIG. 5 is a sectional view showing the shooting operation of the present invention in a third state.

Referring to FIGS. 3 to 5, in a standby state, the air source 6 supplies air into the paint bullet gun. When the arrestor 5 is not yet magnetized, the shaft 423 in the passage 421 is resiliently forced by the resilient member 424 to move backward and contact with the movable member 51 of the arrestor 5. At this time, the air will go through the intake 422 of the arresting section 42 of the valve body 4 and reach a position between the annular groove 4211 of the passage 421 and the second annular groove 4232. The linking member 412 in the tunnel 411 of the linking section 41 is resiliently forced by the spring 413 to move backward away from the cock 414. The valve rod 311 of the valve housing 31 is driven by the linking member 412 to move backward. The air will partially enter the piston barrel 32 to push the piston rod 321 backward. At this time, the gunlock 11 is driven by the piston rod 321 to retreat, permitting a paint bullet 7 to drop into a position in front of the gunlock 11 in a ready state.

When a user pulls the trigger, the arrestor 5 is magnetized to make the movable member 51 move forward and push the shaft 423 into the passage 421. At this time, the shaft 423 compresses the resilient member 424 positioned in the passage 421. The annular groove 4211 has slopes so that when the shaft 423 is slightly moved forward, the annular groove 4211 fast communicates with the first annular groove 4231 by large area. At this time, the air of the air source 6 will go through the intake 422, the annular groove 4211, the second annular groove 4232, the first annular groove 4231 and the ventiduct 43 into the tunnel 411 of the linking section 41 to push the linking member 412 toward the cock 414. Minor part of the air going into the ventiduct 43 will escape through the relief duct 44 into the passage 421 and is reserved. Then, the linking member 412 will compress the spring 413 in the tunnel 411 and pull the valve rod 311 forward. At the same time, the piston rod 321 is pushed forward to drive the gunlock 11 forward. The front end of the gunlock 11 blocks the bullet dropping port 47 to prevent a next paint bullet 7 from dropping so as to avoid clog of the paint bullet. At this time, the other part of the air of the air source 6 will shoot the paint bullet 7 in front of the gunlock 11.

Figure 6:
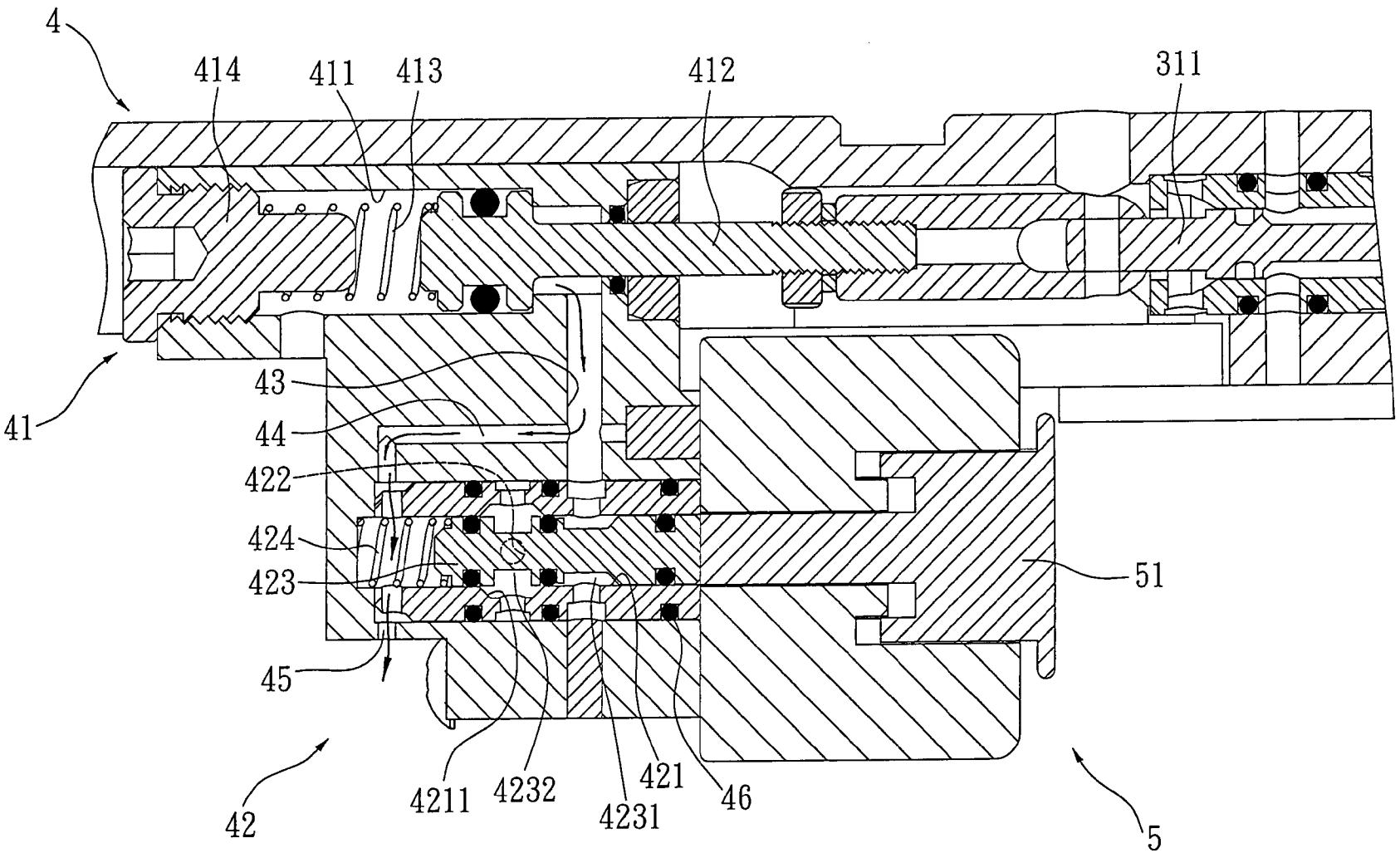
FIG. 6 is a sectional view showing the shooting operation of the present invention in a fourth state.
Figure 7:
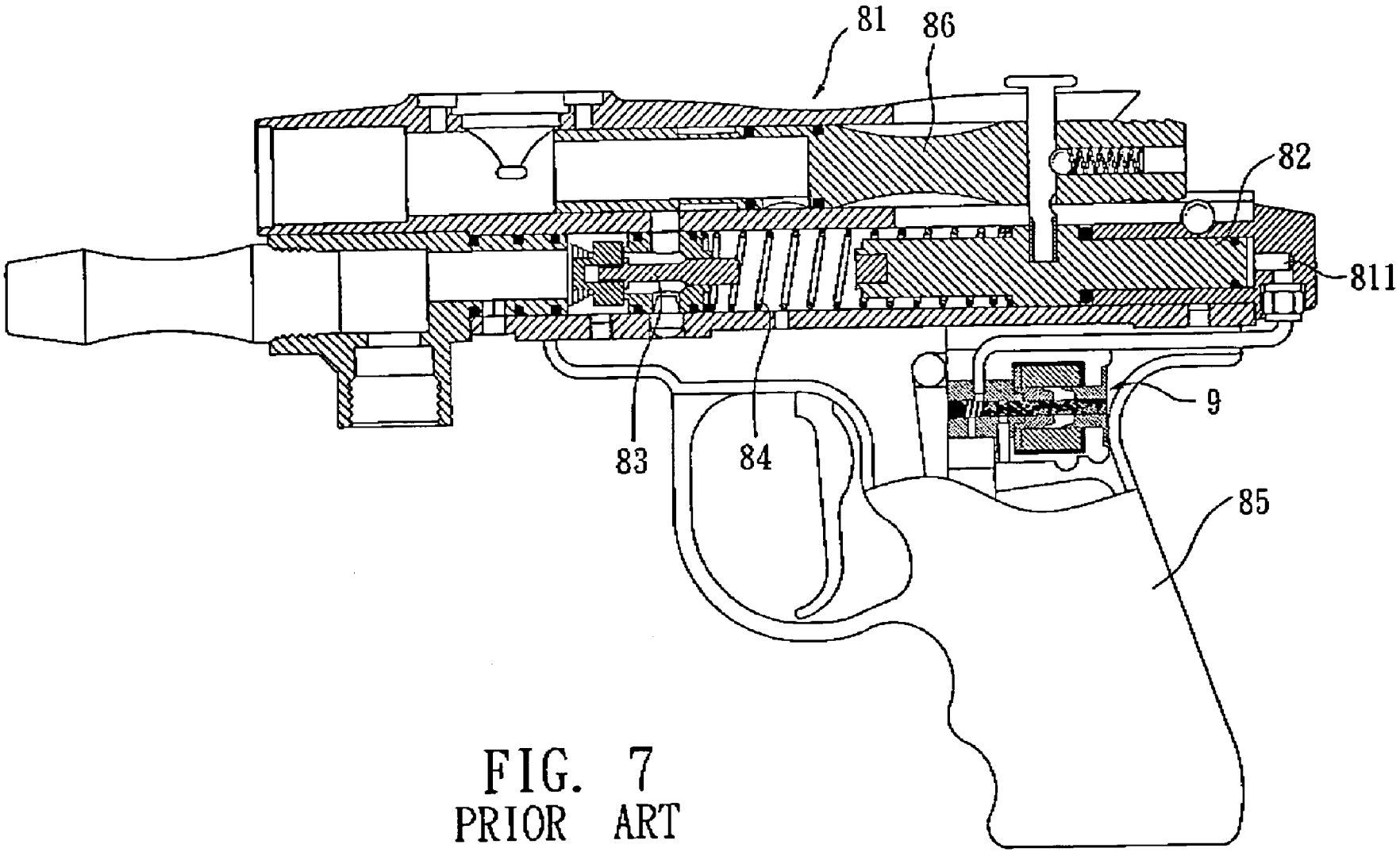
FIG. 7 PRIOR ART
FIG. 7 is a partially sectional view of a conventional paint bullet gun.
Figure 8:
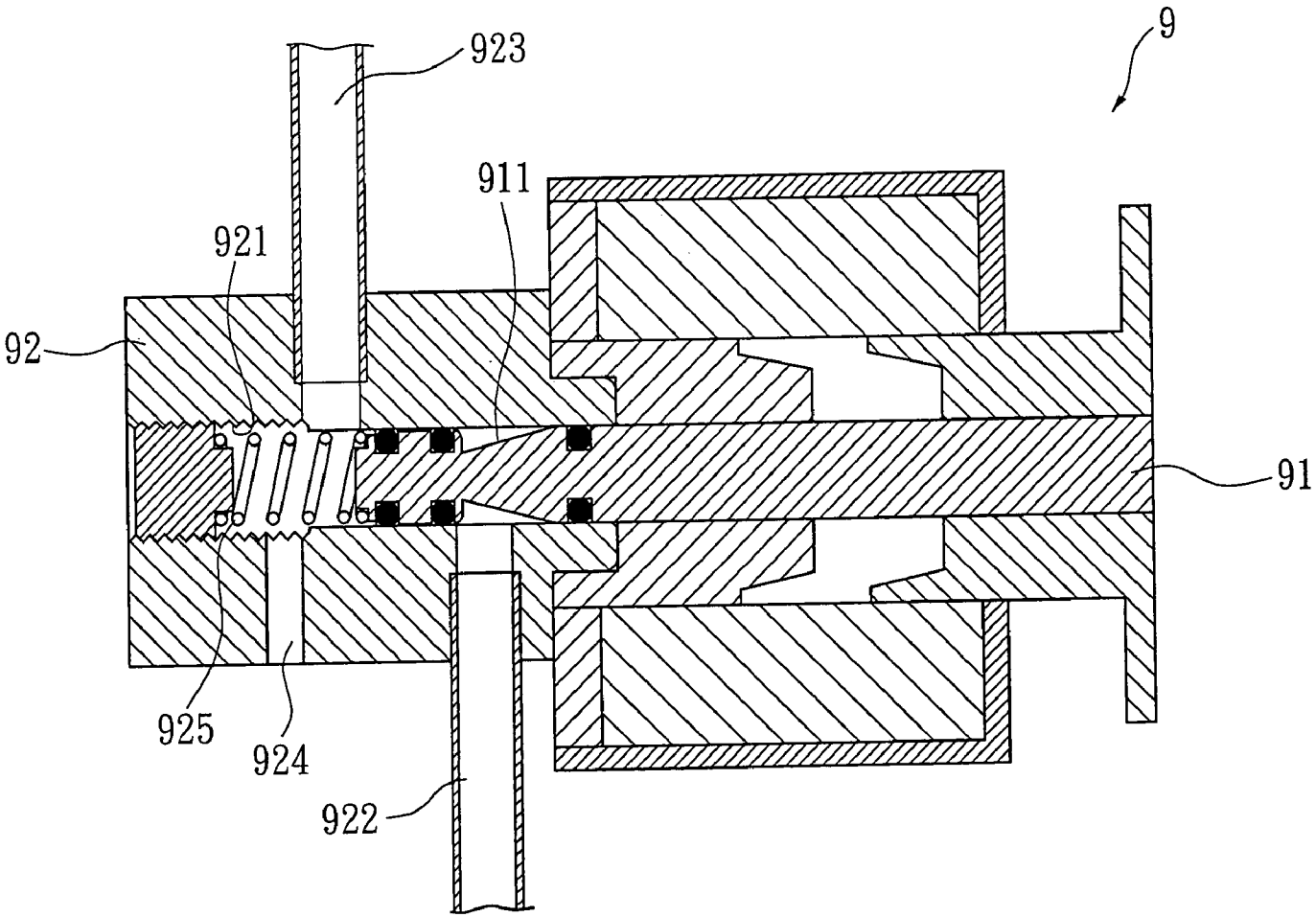
FIG. 8 PRIOR ART
FIG. 8 is a sectional view of the electromagnet of the conventional paint bullet gun.

Referring to FIG. 6, after shooting a first paint bullet 7, the arrestor 5 is demagnetized. The shaft 423 is pushed by the resilient member 424 to restore to its home position. The movable member 51 of the arrestor 5 is pushed backward out of the passage 421 by the shaft 423. At this time, the annular groove 4211 does not communicate with the first annular groove 4231 to block the ventiduct 43. Then, the spring 413 restores to push the linking member 412 backward. The linking member 412 drives the valve rod 311 backward. At this time, the piston rod 321 and the gunlock 11 are both restored to the original standby state. When the linking member 412 is moved backward, the air accumulating in the tunnel 411 of the valve body 4 can totally go through the ventiduct 43 and the relief duct 44 into the passage 421 of the arresting section 42 of the valve body 4. Then the air is exhausted through the escape hole 45 out of the valve body 4. Accordingly, the arrestor 5 is intermittently magnetized and demagnetized to reciprocally move the movable member 51 and the shaft 423 for continuously controlling the intake and exhaustion operation. Therefore, the linking member 412 can be truly reciprocally moved to drive the valve rod 311, piston rod 321 and the gunlock 11 for continuously shooting the paint bullets.

The diameter of the relief duct is smaller than the diameter of the ventiduct. Therefore, the air pressure in the relief duct is also less than the air pressure of the ventiduct. When a shooting operation is completed and the linking member is moved backward, the air accumulating in the tunnel will be fed back into the ventiduct to go through the relief duct into the passage of the valve body. Therefore, the air pressure of the ventiduct and the tunnel can be effectively relieved and the linking member can be truly restored to its home position. Accordingly, the valve rod, the piston rod and the gunlock can be all truly restored for next shooting. Therefore, the paint bullet gun can normally continuously shoot the paint bullets.

Moreover, the present invention is further advantageous in that the diameters of the relief duct and the escape hole are smaller than the diameters of the ventiduct and the passage. Therefore, each time a paint bullet is to be shot, minor part of the air going into the ventiduct will escape through the relief duct into the passage to normally relieve the pressure. In addition, after each shooting operation, the air accumulating in the tunnel of the valve body can totally go through the ventiduct and the relief duct into the passage of the valve body. The air is reserved therein and then exhausted through the escape hole out of the valve body. The reserved air helps the resilient member within the passage in pushing and restoring the shaft for next shooting. By means of such design, a resilient member with weaker elastic coefficient can be used to lower the power consumption of the electromagnet.

The present invention is further advantageous in that by means of the relief duct, the travel of the shaft in the passage is shortened. This also lowers the power consumption of the electromagnet for driving the linking member. Therefore, energy is saved.

The above embodiments are only used to illustrate the present invention, not intended to limit the scope thereof. Many modifications of the above embodiments can be made without departing from the spirit of the present invention.

What is claimed is:

1. A paint bullet gun comprising:

a barrel;

a handle;

a bolt and a strike-controlling unit are disposed in the barrel;

a valve body and an arrestor being disposed in the handle, the arrestor being adjacent to the valve body for driving the valve body;

an air source being arranged under the barrel for supplying air into the barrel and the valve body to control the valve body and the strike-controlling unit, the strike-controlling unit serving to control the bolt to reciprocally move for dropping a paint bullet and shooting the paint bullet with the air of the air source;

the valve body has a linking section and an arresting section, the linking section being formed with a tunnel, a linking member and a spring being sequentially mounted in the tunnel in a direction to an opening of the barrel;

the arresting section is formed with a passage communicating with the tunnel via a ventiduct, the passage communicating with the air source via an intake, the middle of an inner wall face of the passage being formed with an annular groove corresponding to the intake, the annular groove having a trapezoidal cross-section with slopes, whereby the air can go from the air source into the passage;

a shaft and a resilient member are accommodated in the passage, one end of the shaft contacting with the arrestor, the other end of the shaft being pushed by the resilient member, via a relief duct, the ventiduct communicating with a part of the passage, in which part the resilient member is accommodated, the arresting section being formed with an escape hole opposite to the relief duct, the escape hole communicating with the part of the passage, in which part the resilient member is accommodated, the diameters of the relief duct and the escape hole being smaller than the diameters of the ventiduct and the passage; and the shaft is formed with a first annular groove, when the shaft is reciprocally moved, the first annular groove being moved to a position corresponding to the ventiduct or moved away from the position corresponding to the ventiduct so as to switch a communication state and discommunication state between the first annular groove and the annular groove of the passage.

2. The valve structure of the paint bullet gun as claimed in claim 1, wherein the arrestor is an electromagnet having a movable member, when the electromagnet is magnetized and demagnetized, the movable member being reciprocally moved, one end of the movable member being adjacent to the shaft in the arresting section of the valve body for driving the shaft.

3. The valve structure of the paint bullet gun as claimed in claim 1, wherein several O-rings are inlaid in a circumference of the shaft on two sides of the first annular groove, the O-rings abutting against inner wall face of the passage to avoid leakage.

4. The valve structure of the paint bullet gun as claimed in claim 1, wherein the strike-controlling unit further includes a valve housing and a piston barrel, an interior of the valve housing communicating with the air source and an interior of the piston barrel, whereby the air input to the valve housing can further go into the piston barrel.

5. The valve structure of the paint bullet gun as claimed in claim 4, wherein a valve rod is mounted in the valve housing and connected with one end of the linking member, a piston rod being disposed in the piston barrel, one end of the piston rod being connected with the bolt for driving the bolt.

6. The valve structure of the paint bullet gun as claimed in claim 1, wherein a cock is disposed in the tunnel for blocking the tunnel.

7. The valve structure of the paint bullet gun as claimed in claim 1, wherein the circumference of the shaft is further formed with a second annular groove corresponding to the annular groove of the passage.

* * * * *